US007936547B2

(12) United States Patent
Dougherty et al.

(10) Patent No.: US 7,936,547 B2
(45) Date of Patent: May 3, 2011

(54) CIRCUIT BREAKER ELECTRONIC TRIP UNIT PERSONALITY MODULE

(75) Inventors: John James Dougherty, Collegeville, PA (US); Geoff F. Butland, Farmington, CT (US); Mark Fredrick Culler, Prospect, KY (US); Nataniel Barbosa Vicente, Prospect, KY (US)

(73) Assignee: General Electric Company, Schenectady, NY (US)

( * ) Notice: Subject to any disclaimer, the term of this patent is extended or adjusted under 35 U.S.C. 154(b) by 69 days.

(21) Appl. No.: 11/949,843

(22) Filed: Dec. 4, 2007

(65) Prior Publication Data

US 2008/0158763 A1 Jul. 3, 2008

Related U.S. Application Data

(63) Continuation-in-part of application No. 11/617,949, filed on Dec. 29, 2006, now abandoned.

(51) Int. Cl.
*H01H 73/00* (2006.01)

(52) U.S. Cl. ..... 361/93.2; 361/115

(58) Field of Classification Search ..... 361/62, 361/64, 66, 115, 93.2, 93.3
See application file for complete search history.

(56) References Cited

U.S. PATENT DOCUMENTS

| | | | | |
|---|---|---|---|---|
| 4,672,501 | A | 6/1987 | Bilac et al. | |
| 4,958,252 | A | 9/1990 | Murphy | |
| 5,596,473 | A * | 1/1997 | Johnson et al. | 361/97 |
| 5,666,256 | A * | 9/1997 | Zavis et al. | 361/115 |
| 5,943,201 | A * | 8/1999 | Walker et al. | 361/64 |
| 6,534,991 | B2 | 3/2003 | Marple et al. | |
| 6,678,135 | B2 | 1/2004 | Tignor et al. | |
| 7,092,228 | B1 * | 8/2006 | Hochgraef et al. | 361/93.1 |
| 2003/0048589 | A1 | 3/2003 | Tignor | |

FOREIGN PATENT DOCUMENTS

EP 1189324 A 3/2002

* cited by examiner

*Primary Examiner* — Danny Nguyen
(74) *Attorney, Agent, or Firm* — Global Patent Operation; Stephen G. Midgley

(57) ABSTRACT

A method and apparatus providing automatic circuit breaker identification to an electronic trip unit includes a processor and a configuration module comprising configuration data identifying the particulars of a circuit breaker and that is in operable communication with the processor.

12 Claims, 4 Drawing Sheets

CIRCUIT BREAKER ELECTRONIC TRIP UNIT PERSONALITY MODULE

CROSS REFERENCE TO RELATED APPLICATIONS

This application is a Continuation in Part of U.S. patent application entitled "Circuit Breaker Electronic Trip Unit Personality Module", Ser. No. 11/617,949, filed Dec. 29, 2006, now abandoned.

BACKGROUND OF THE INVENTION

Circuit breakers are widely used to protect electrical lines and equipment. The circuit breaker monitors current through an electrical conductor and trips to interrupt the current if certain criteria are met. One such criterion is the maximum continuous current permitted in the protected circuit. The maximum continuous current the circuit breaker is designed to carry is known as the frame rating. However, the breaker can be used to protect circuits in which the maximum continuous current is less than the circuit breaker frame rating, in which case the circuit breaker is configured to trip if the current exceeds the maximum continuous current established for the particular circuit in which it is used. This is known as the circuit breaker current rating. Obviously, the circuit breaker current rating can be less than but cannot exceed the frame rating.

An electronic trip unit ("ETU") is a device that is used in conjunction with an electro-mechanical circuit breaker to control the current versus time trip response (also voltage). The current versus time trip characteristics are, in part, a function of the maximum continuous current permitted by the circuit breaker. This maximum continuous current is also called the current rating of the circuit breaker. As long as the current remains below this maximum continuous current rating, the breaker will remain closed. Momentary low magnitude excursions above the rated current are tolerated; however, persistent overcurrent conditions result in tripping of the breaker. The time delay and generation of the trip signal is an inverse function of the magnitude of the current. For very large magnitude overcurrents, such as would be produced by a fault, the microcontroller is programmed to generate a trip signal instantaneously.

The modification of the current versus trip time response curve is a serious matter. For safety purposes, the circuit breaker and trip unit combination must be properly configured to provide the type of protection judged by the customer or plant engineer to be appropriate. Therefore, the modification to this protection must also be considered to be a very serious event and handled in a way that prohibits errors.

Typically the breaker current rating is defined in two parts. The current sensor installed in the breaker has a rating less than or equal to the frame rating of the breaker. This is referred to as the breaker Sensor Rating. The current rating is further modified by installation of a rating resistor, which is selected to generate a preset voltage when a current proportional to the maximum continuous current permitted in the protected circuit passes through the rating resistor. In order to provide for adjustment of current rating so that the circuit breaker can be used to protect circuits with different maximum continuous currents, it is known to incorporate the rating resistor in a replaceable rating plug, which may be selectively inserted in to the breaker.

Electronic trip circuit (ETU) interrupters are designed to interrupt overcurrent conditions over a wide range of ampere rating. The current through the protected electric power circuit is continuously sensed by means of current transformers and a voltage signal is supplied to the signal processor within the ETU circuit A common electronic circuit interrupter can operate over a wide range of ampere ratings by merely changing the rating plug. It is important to prevent the insertion of an electronic circuit into a circuit interrupter which results in a current rating greater than the sensor rating or frame rating. This can result in a condition where the electrical distribution circuit is not protected. Similarly, it is important not to insert an electronic circuit into a circuit interrupter that results in an unintentional low trip level that allows so-called "nuisance tripping" to occur. Finally, standards require that a circuit interrupter with a replaceable current rating (like a rating plug) either do not close or trip at or below the lowest published current trip level if the rating plug is not inserted.

Field replaceable rating plugs are known. These rating plugs are field installable and may be mechanically configured for use with thermal-magnetic trip units or may use a combination of analog circuit scaling and digital techniques to change the ETU response. It is typical for ETU housings to provide mechanical rejection of plugs that are not suited to certain ranges or frame sizes.

A typical method to prevent incompatible ETU/rating plug combinations includes a first manufacturing process of providing interlocking pins that can be mechanically modified by a secondary manufacturing process of breaking out pieces. The secondary manufacturing process breaks out small pieces of plastic on the housing of the rating plug and complementary pieces on the housing of the ETU.

Current sensors are typically installed as part of the circuit breaker during manufacture. A unique identifying number is assigned to the circuit breaker, which defines the frame rating and sensor rating. The electronic trip unit is configured at the time of manufacture to indicate the frame and sensor ratings of the circuit breaker or circuit breakers with which it is compatible. A unique identifying part number is assigned to the configured trip unit. A specifying engineer orders a specific combination of trip unit and circuit breaker to satisfy the requirements of the power system installation. Appropriate combinations are enforced through mechanical or electronic rejection.

A problem associated with mechanical rejection of plugs and trip units is the cost associated with the secondary operation and the limitation of the number of combinations that can be rejected. In some cases the mechanical rejection method is not reliable because some operators, using great force, can insert an incorrect rating plug or install an incorrect trip unit.

Manufacturers also use mechanical rejection in the interface between the trip unit and the circuit breaker mounting point for the trip unit. Trip units are configured, in part, to match the characteristics of the underlying circuit breaker's sensor rating, presence or absence of additional sensors, frame rating, and breaker type. Rejection methods similar to those described for rating plugs are employed to ensure that only a properly matched trip unit can be successfully installed to a circuit breaker. Similarly, mechanical rejection means may be overcome by the application of excessive force, resulting in an invalid and potentially unsafe configuration.

In use, electronic trip units may be exchanged from one circuit breaker to another during the course of maintenance of a power distribution system, or when upgrading the trip unit in a breaker that has been in service for several years, an activity known as "retrofitting". Newly designed trip units are often required to maintain "backwards compatible" mechanical and electrical interfaces to existing trip systems, sometimes several different trip systems, which adds cost and complexity to new designs.

When retrofitting a new trip unit to an older circuit breaker, the mechanical rejection means employed by the circuit breaker must be carried through to the new trip unit. If the trip unit is intended for use in several different breaker products the number of rejection permutations can be unmanageably large. The specifying engineer may need to properly identify not only the correct breaker, trip unit, and rating plug combinations, but also an appropriate 'retrofit kit' in order to upgrade the trip system.

Circuit breakers having electronic trip units are well known in the art. Patented disclosures of such circuit breakers having electronic trip units may be found, for example, in U.S. Pat. Nos. 4,672,501; 6,678,135; and 6,534,991.

Commercially available circuit breakers are constructed to operate for decades in permanent electrical switchgear installations. The systems in which these circuit breakers operate are built to serve the electrical needs of the facility as envisioned at the time of their initial design. However, over time, these initial needs may often change, regulatory imperatives may often force modifications, or advances in protection technology in time may provide compelling reasons to update the switchgear's initial mission. Due to the size and complexity of a typical electrical switchgear installation, and the rugged nature of circuit breakers, it is rarely necessary, or economical, to replace the switchgear or breakers in order to modify or upgrade an electrical system's protection capabilities.

New advances in protection technology may be (and often are) deployed in existing switchgear by upgrading the trip units that control the breakers' operation. These electronic "brains" continually monitor the electrical conditions of the breaker and its attached loads, and will command the breaker mechanism to open if established electrical operating limits are violated.

As indicated above, the problem faced when upgrading circuit breaker trip units is that the mechanical and electrical interface between the circuit breaker mechanism and the trip unit often varies widely from breaker to breaker, even among breakers from the same manufacturer. Additionally, regulatory requirements permit only properly configured trip unit/breaker combinations. Complex mechanical and electronic "rejection" features are in place to prevent the installation of mismatched trip unit/breaker pairs. These rejection features are typically unique to each breaker and trip unit family, with thousands of possible permutations.

When a new trip unit is created and becomes commercially available, i.e., a unit offering newer features and better performance than earlier models, the job of matching the new device to the myriad of existing interfaces is daunting and time consuming. In short, different existing circuit breakers may contain a unique breaker interfaces designed only for that circuit breaker, and trip units designed for that specific unique interface may not be replaced by a trip unit designed for another specific circuit breaker.

Another problem known in the circuit breaker industry is one of counterfeit electronic trip units. By copying the form and circuitry of electronic trip units, counterfeiters develop and sell electronic trip units of poorer quality which are labeled falsely as manufactured by a known circuit breaker company. Mechanical features of rating plug and trip unit rejection schemes are easy to view and copy.

Presently, dozens of varieties of a basic trip unit may be required in order to satisfy the variety of breaker installations available and desirable for retrofit. Thus, there are still a number of drawbacks and deficiencies in currently utilized apparatus for circuit breaker technology for which additional technical advances are needed. The method and apparatus described herein address such an advance.

The aspects of the presently described invention will become more readily apparent to the reader with regard to the following figures and detailed description:

BRIEF SUMMARY OF THE INVENTION

Figure 1:
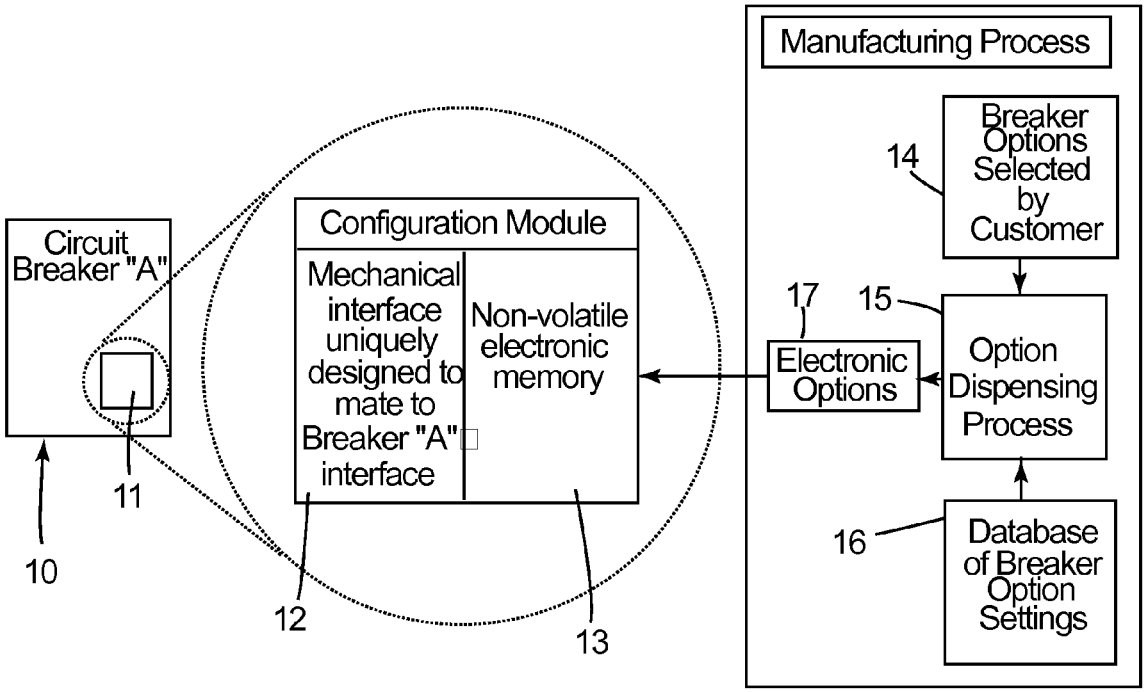
FIG. 1 is a generalized depiction of the apparatus, including a depiction of its manufacturing process.

The above-discussed and other drawbacks and deficiencies are overcome or alleviated by a method and apparatus for automatic identification of the circuit breaker configuration that includes a processor and a configuration module comprising configuration data identifying the particulars of a circuit breaker and that is in operable communication with the processor. In optional embodiments, the processor may also be programmed to determine an overcurrent condition of the circuit breaker and a first memory may be in operable communication with the processor. The configuration module may be releasably engaged with the processor-based configuration module wherein the configuration module includes a second memory that can be placed in operable communication with the processor, wherein the processor may read the configuration of the circuit breaker from the second memory, and then accesses a plurality of programs in the first memory based on this characteristic data, and wherein, the one of a plurality of programs instructs the microprocessor to modify the current vs. time configuration of the electronic configuration module and wherein the combination of configuration module and configuration module comprise the circuit breaker trip unit.

DETAILED DESCRIPTION OF THE INVENTION

In accordance with one embodiment of the present invention, mechanical and electrical rejection and breaker mounting methods are separated from trip unit functionality through the use of a trip unit personality module, or configuration module. The configuration module described may be configured for a specific breaker application, incorporating any unique mechanical mounting requirements. The configuration module also comprises a memory such as a non-volatile memory, or "NVM" device that stores information unique to a specified circuit breaker. For example, breaker frame size, breaker sensor rating, breaker sensor type, breaker capability data, neutral position, interrupt rating, agency standard, protection options, protection set points and/or breaker type may each be stored. In this way the configuration module replaces the mechanical rejection features of previous generation trip units.

The configuration module provides mechanical and electronic interfaces, as well as electronic protocols and is mountable to a circuit breaker.

One advantage of the present embodiment is that the configuration module is replaceable. Rather than creating a unique electronic trip unit for each breaker application, a generic configuration module is employed that may be inserted with user configuration data and that can be connected to the breaker and to the electronic trip unit to form a complete and integrated system. In one particular embodiment, the electronic trip unit may read configuration data stored on an electronic trip unit memory to determine an electronic trip unit unique identification or ID, that may identify what type, make or model circuit breaker, neutral position, interrupt rating, agency standard, protection options, set points and sensors are pertinent to that electronic trip unit. If the electronic trip unit ID read matches the ID saved in the configuration module NVM, the configuration module uses a particular set of options and set points stored in the configuration module NVM. This is the normal operation each time that a configured electronic trip unit and configuration module powers up after the user has entered operating set points. If the ID's do not match, or if the configuration module does not have an electronic trip unit ID (initial installation), the electronic trip unit may be instructed via firmware or software to configure itself, e.g., to operate on a default option and set points appropriate for the specific breaker frame and sensors indicated by the electronic trip unit ID. In such a case, the user may receive an alarm indication (warning on the LCD display, closing of a contact, communication warning) to indicate that the trip unit has not been configured. The customer can then re-configure the electronic trip unit on the site to use parameters (options, set points, frame, sensor etc) from the configuration module. If the trip unit cannot read the trip unit ID from the configuration module or the security encrypted in the ID do not match, the trip unit trips the circuit breaker, ensuring that an unsafe electrical distribution condition is not created.

As depicted in FIG. 1, circuit breaker "A" 10 comprises a circuit breaker ~~f~~personality module or configuration module 11 according to one embodiment of the present invention. The configuration module 11 may comprise a mechanical interface 12 uniquely designed to mate with an appropriately mechanically configured receptacle in the circuit breaker 10, and, in one particular embodiment be releasably engaged with an electronic trip unit (described below in conjunction with FIG. 3). In addition to the interface 12, the configuration module 11 further comprises a memory 13, such a non-volatile electronic memory that may be electronically inserted with configuration data. An exemplary process for electronic insertion of configuration data begins, as depicted in FIG. 1, with the breaker options being selected by a user 14 specific for their individual needs; these options, together with a database of breaker options settings 16 provided by the manufacturer specific for a wide variety of conditions are then combined within an option dispensing process 15, and converted into electronic options 17 that are then provided to option the configuration module as to its desired parameters. Depending upon the options selected and the date code, alternatively the version number of the configuration module, an encryption key is created in the option dispensing process and this key may be appended to an associated electronic trip unit ID as a security measure.

Figure 3:
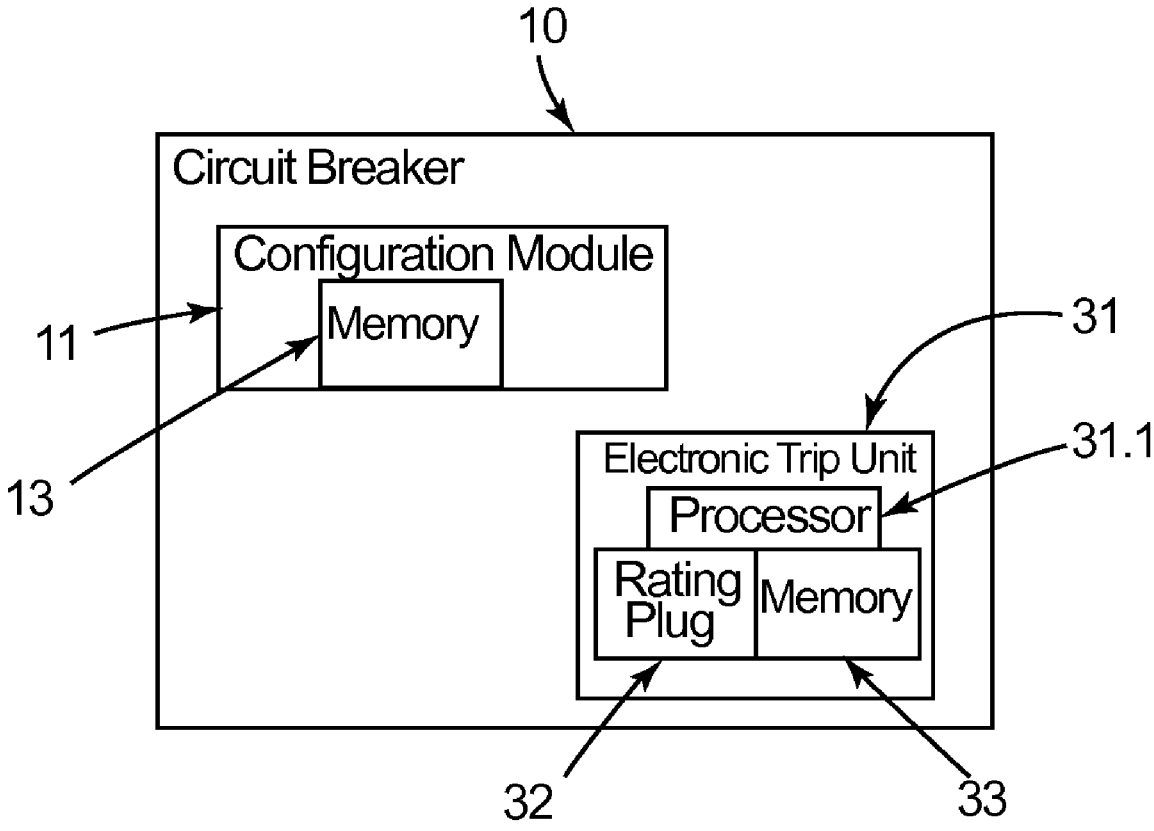
FIG. 3 is a generalized depiction of the personality module as shown in FIG. 2.

Referring now also to FIG. 3 a circuit breaker 10 is shown with a configuration module 11 and a memory 13 along with an electronic trip unit 31 comprising a processor 31.1 and a memory unit 33 which may comprise a non-volatile memory. A removable rating plug 32, such as that described above, may be inserted into the trip unit 31 to modify the current rating of the circuit breaker 10. The processor 31.1 of the electronic trip unit 31 is in operable communication with the configuration module 11.

Figure 4:
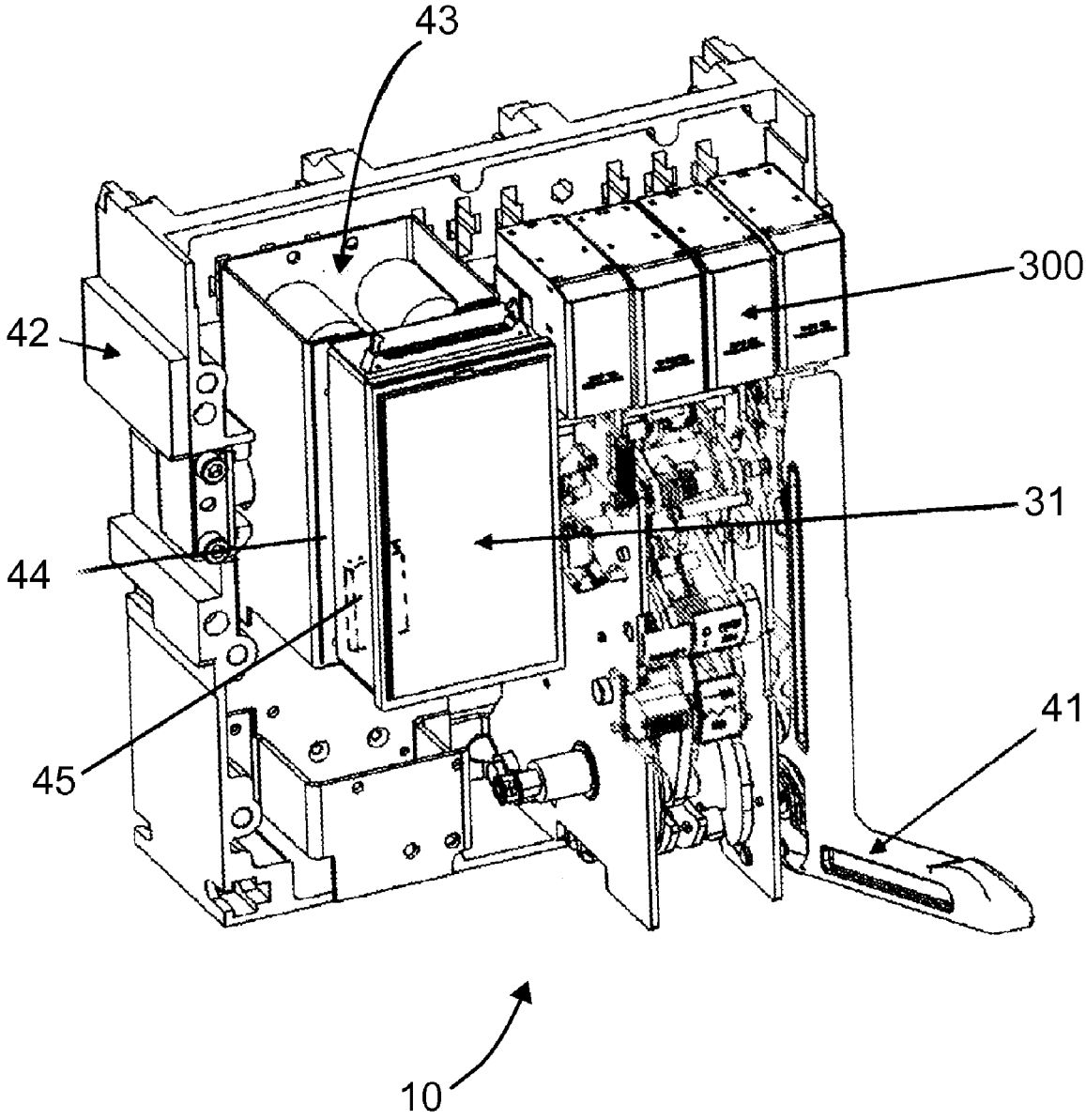
FIG. 4 is a generalized depiction of a conventional circuit breaker with the protective cover removed.

Without its protective cover to isolate the exterior environment from the internal workings and current within the breaker itself, a typical assembled circuit breaker is depicted in FIG. 4. The typical breaker 10 includes a number of mechanical apparatus mounted onto a breaker frame 11 such as user installable accessories 300, and a manual trip lever 41 that may be operated by the user to manually allow or halt the flow of electric current through the circuit breaker. Also shown in FIG. 4 is a breaker mounting unit 43 attached to the frame, and attached to the front of the breaker mounting unit 43 is a breaker mounting plate 44 to which the configuration module 11 according to the present embodiment is permanently attached (shown at 45, phantom lines).

Figure 2:
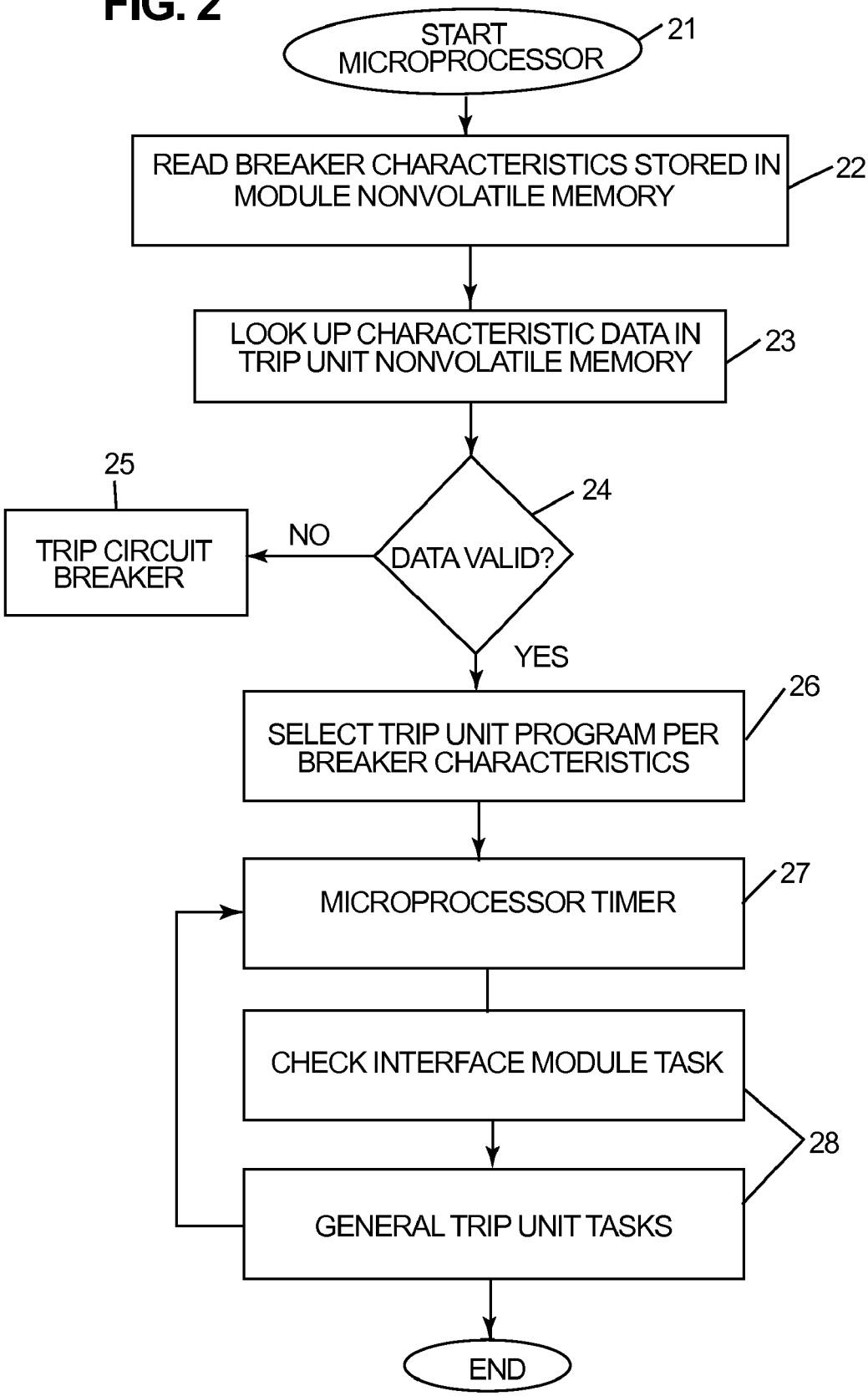
FIG. 2 is a generalize flow diagram depicting a typical trip unit program execution logic.

The execution logic of the firmware or software within the processor 31.1, is depicted in FIG. 2 and begins with a boot sequence 21 when the processor is first energized and launches its operating system and begins executing program instructions. These instructions may comprise reading, at 22, circuit breaker 10 configuration stored in the non-volatile memory 13 of the configuration module 11; comparing configuration data (electronic ID), at 23, provided the module during its manufacturing process and stored within the trip unit's non-volatile memory; and determining whether the data (configuration module ID and trip unit ID) matches or not. Note that the ID stored in the factory in the configuration module can include a second encryption key, again depending on version number and date code which the microprocessor software uses to decode the configuration module ID key and qualify the configuration module and the electronic trip unit as matched, non-counterfeit units. If the processor 31.1 determines that the ID matches, then the trip unit will use the options and set points within its NVM (at 26) and continually to check configuration module 11 tasks and general trip unit tasks (at 28) at a predetermined time interval (at 27). Such execution logic programs are generally standardized within the industry. If the microprocessor determines the ID's do not match it will default to a save protection options and set points it may also provide an alarm and/or LCD display and/or trip the breaker 25.

If the processor 31.1 cannot read the ID from the configuration module 11 or if the ID is invalid (qualified by encryption or other security measure known to one skilled in the art), the processor will issue a trip signal to prevent unsafe or counterfeit operation.

The configuration module 11 according to the present invention offers a number of advantages: first, it divorces the development of new trip units from the development of unique mechanical interfaces thereby allowing the manufacture of a single complex trip unit assembly instead of a number of different specific assemblies; second, a common mechanical and electrical interface is established, paving the way for faster, simpler, and more cost effective upgrades as protection technology advances, or as customer needs change; third, by establishing a consistent electronic rejection method means that future projects will not need to replicate a large number of mechanical rejection methods; fourth, the configuration module provides a means for encryption to defeat or severely limit counterfeit versions of the electronic configuration modules; and finally, new breaker applications can be realized easily by implementing a universal personality module as depicted, and modifying the software in the within the module as needed.

While we have illustrated and described a preferred embodiment of this invention, it is to be understood that this invention is capable of variation and modification, and we therefore do not wish to be limited to the precise terms set forth, but desire to avail ourselves of such changes and alternations which may be made for adapting the invention to various usages and conditions. Accordingly, such changes and alterations are properly intended to be within the full range of equivalents, and therefore within the purview, of the following claims.

What is claimed is:

1. An electronic trip unit apparatus mountable to a circuit breaker, the electronic trip unit comprising:

a processor;

a first memory in operable communication with the processor; and configured to store a first trip unit identification (ID);

a configuration module mountable to the circuit breaker and configured to be in operable communication with the processor, the configuration module comprising a second memory configured to store a second circuit breaker ID, the configuration module further configured to provide the processor with the second circuit breaker ID;

wherein the processor is configured to:

(a) determine the first trip unit ID and the second circuit breaker ID;

(b) determine if the first trip unit ID and the second circuit breaker ID match; and in the event the first trip unit ID and the second circuit breaker ID do not match, (c) trigger the trip unit to perform a predetermined operation.

2. An electronic trip unit apparatus according to claim 1 wherein the processor is also programmed to determine an overcurrent condition of the circuit breaker.

3. An electronic trip unit apparatus according to claim 1 wherein the configuration module is releasably engageable with the trip unit.

4. An electronic trip unit apparatus according to claim 3 wherein the configuration module includes a mechanical interface uniquely configured for a particular circuit breaker.

5. An electronic trip unit apparatus according to claim 1 wherein:

the first memory comprises a non-volatile memory; and the second memory comprises a non-volatile memory.

6. An electronic trip unit apparatus according to claim 5 wherein the predetermined operation modifies a current versus time characteristic of the electronic trip unit apparatus.

7. An electronic trip unit apparatus according to claim 5 wherein the predetermined operation is a determination that a counterfeit configuration module is present.

8. An electronic trip unit apparatus according to claim 5 wherein the processor is instructed with an encryption scheme, implemented with encrypted keys for communication between the processor and the configuration module and said processor is instructed to detect a counterfeit configuration module when no encryption key is present in the configuration module.

9. An electronic trip unit apparatus according to claim 5 wherein the configuration module is inserted with configuration data by a user.

10. An electronic trip unit apparatus according to claim 1, wherein the predetermined operation triggers a trip operation of the circuit breaker.

11. An electronic trip unit apparatus according to claim 1, wherein the first memory is further configured to store a first plurality of set points; and wherein the predetermined operation changes the first plurality of set points to a predetermined second plurality of set points.

12. An electronic trip unit apparatus according to claim 1, wherein the predetermined operation triggers an alarm indication.

* * * * *